US005115584A

United States Patent [19]

Lucchetti

[11] Patent Number: 5,115,584

[45] Date of Patent: May 26, 1992

[54] ARTIST'S SECTIONAL STRETCHER WITH CANVAS

[75] Inventor: Renato Lucchetti, Appiano Gentile, Italy

[73] Assignee: ColArt International, S.A., France

[21] Appl. No.: 471,550

[22] Filed: Jan. 29, 1990

[30] Foreign Application Priority Data

Feb. 10, 1989 [IT] Italy ..... 19416 A/89

[51] Int. Cl.[5] ..... D06C 3/08

[52] U.S. Cl. ..... 38/102.91

[58] Field of Search ..... 38/12, 66, 69, 70, 73, 38/102.1, 102.2, 102.3, 102.4, 102.91, 108, 143; 24/455, 457, 458, 467, 470, 500, 501, 511, 526, 570; 160/371, 374.1, 378, 398, 404; 248/575, 447.1, 478

[56] References Cited

U.S. PATENT DOCUMENTS

| | | | |
|---|---|---|---|
| 2,456,225 | 12/1948 | Thomas | 38/102.91 |
| 3,255,540 | 6/1966 | Gilman | 38/102.91 |
| 3,950,869 | 4/1976 | Samarin | 38/102.91 |
| 3,978,905 | 9/1976 | de Lama | 38/102.91 X |
| 4,097,968 | 7/1978 | Pikus | 38/102.91 X |
| 4,161,977 | 7/1979 | Baslow | 160/374.1 X |
| 4,194,312 | 3/1980 | Connors et al. | 38/102.5 |
| 4,658,522 | 4/1987 | Kramer | 38/102.91 |

*Primary Examiner*—Werner H. Schroeder
*Assistant Examiner*—Ismael Izaguirre
*Attorney, Agent, or Firm*—Kirschstein, Ottinger, Israel & Schiffmiller

[57] ABSTRACT

An artist's framing kit includes a plurality of resilient elements for fixing and for simultaneously resiliently tensioning a canvas on a stretcher frame. Each resilient element is selectively positioned at, and removable from, desired locations about the stretcher frame to permit localized tensioning of the canvas.

13 Claims, 9 Drawing Sheets

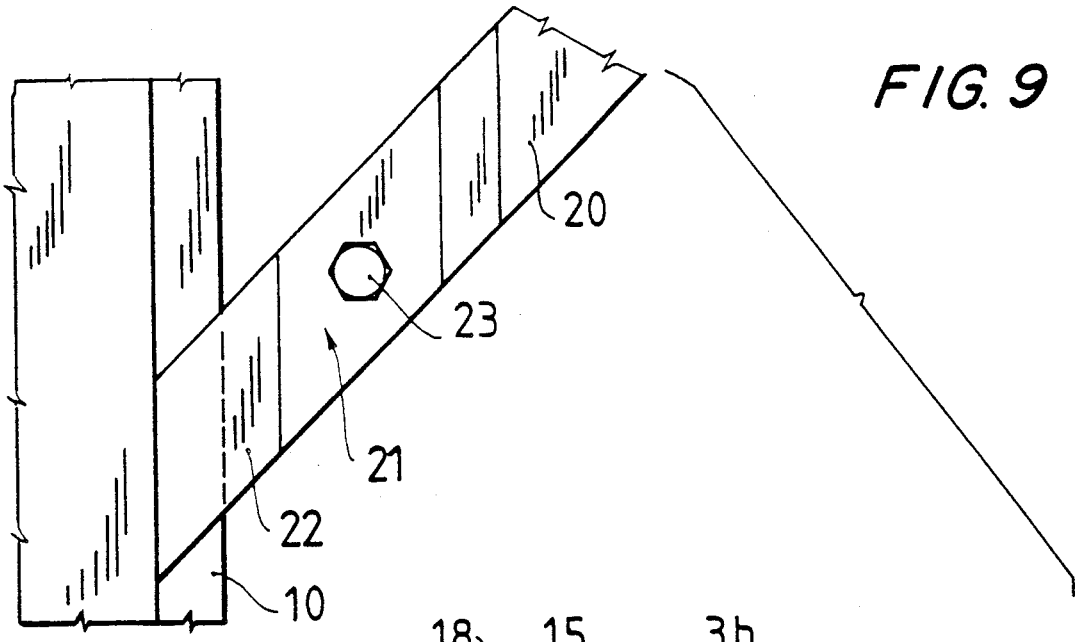
FIG. 9
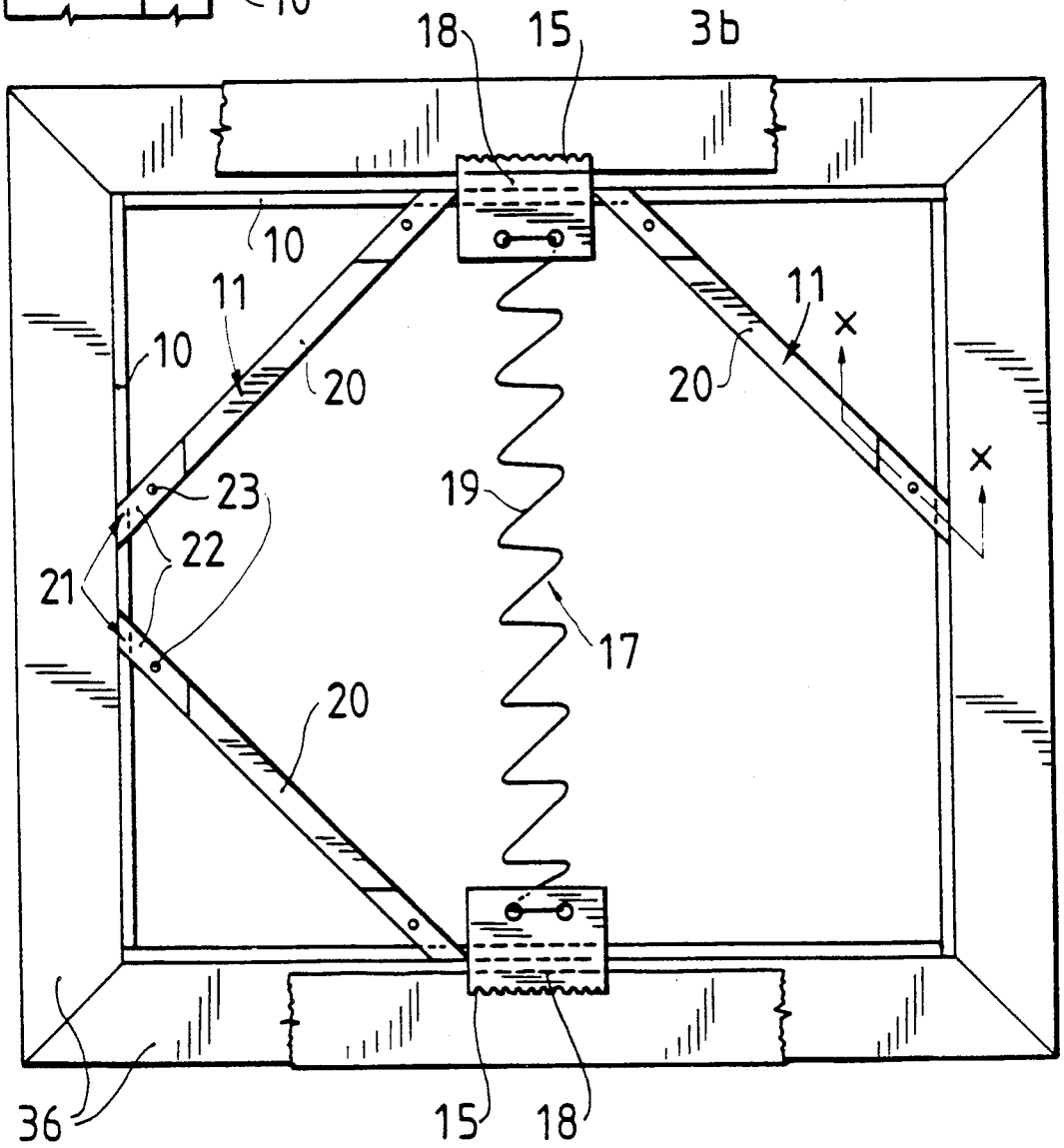

ARTIST'S SECTIONAL STRETCHER WITH CANVAS

BACKGROUND OF THE INVENTION

1. Field of the Invention

The present invention relates to an artists' sectional stretcher with canvas.

2. Related Art

As is known, artists stretchers with canvas have hitherto comprised a stretcher part on which the canvas is fixed by means of metal staples or tacks. Fixing of this type takes place at the outer perimeter edge of the stretcher. Such stretchers may fundamentally be subdivided into two types, more specifically rigid or non-expandable stretchers and expandable stretchers having mobile, sides. In the latter there are provided, in the end zones of the sides of the stretchers, mating seats for the ends of the stretcher sides and housing seats for expander elements, in the form of substantially V-shaped springs or wedges, whose purpose is to create an expanding, or spacing, effect between each two adjacent sides of the stretcher, so as to keep the canvas properly tensioned, both during the act of fixing the canvas and subsequently, following the known dilations or shrinkages of the canvases, as are well known in the art. When canvas-tensioning springs are used, the stretchers have also to be provided with right-angled tubular corner-pieces in their corner zones. the stretchers having wedges, by contrast, the tensioning of the canvas takes place manually, as the result of more or less extensive insertion of wedges by percussion in the corner zones of the stretcher.

It is likewise known that all these solutions, while processing specific advantages, likewise possess disadvantages of various types, some of which they possess in common. In the first place, the fixing of the canvas requires a certain skill, a certain strength and, in any event, a long fixing time. The uniformity of the tensioning of the canvas further depends on the skill of the operator. Not all users, in particular young people, students and ladies, are able to apply the canvas correctly. It is further known that, during the drying of the canvas, following moistening thereof as a consequence of the application of paints or as a result of the absorption of atmospheric humidity, unattractive curvi-linear "crescent" deformations occur along the perimeter edges of the stretcher, between adjacent tacks. The gap or distance between the tacks must on the one hand be sufficiently small to reduce such phenomena and permit uniform tesnioning of the canvas, but on the other hand the tacks act like wedges in the stretcher and an excessively short distance between them may result in breakage of the stretcher. During the shrinkage of the canvases on rigid stretchers the latter, particularly if of large dimensions, undergo substantial deformations, which, in turn, comprise zones of slackening and the formation of corresponding creases in the canvases.

It is further known that, in the zones of folding of the canvases in the outer corner zones, three superposed layers of canvas are formed which, in the case of canvases of a certain thickness, for example 1 mm, possess a thickness of 3 mm. Such thicknesses are cumulative on two opposite sides. In expandable stretchers, therefore, their height and width dimensions comprise the height and width values of the stretcher plus said enlargements resulting from the application of the canvas, plus additionally the total stretching or expansion which takes place and which varies from time to time as a function of the type of canvas and of the contractions or dilations thereof. The result of this is that, with equal external dimensions of the stretcher, problems of seating arise, during framing of these expandable stretchers, in the relative seats of the picture frames, in that these seats do not have large tolerances, and in fact are made, for reasons of cost, to be increasingly small or permit only small dimensional tolerances of the stretcher. The result, therefore, is that stretchers that are only slightly expanded fall out of the seating of the respective picture frame, while stretchers which are substantially expanded do not even fit into said seatings, as a result of which it is often impossible to use picture frames of standardized dimensions. It has therefore frequently been found that frames are not disposed to welcome these stretchers that expand by means of corner springs. These springs moreover, acting exclusively in the corner zones, cannot provide the same effectiveness in canvases of small dimensions or of large dimensions, such effectiveness obviously diminishing with the increase in the dimensions of the stretcher. The fixing of the canvas with metal staples or tacks further requires that the sides of the stretchers be made of wood. This material is notoriously subjected to continuous intrinsic deformations and, in the production of expansion-type stretchers, exhibits substantial wastage, for example of the order of 15–20%. Such wastage, combined with the need for special working of the ends of the sides of the stretchers and with the need for wedges or springs for resilient prestressing, and for the angled corner-pieces, entails high production costs. In practice, furthermore, it is not possible for the user to shorten the lengths of the sides of the stretchers purchased, for example in order to create smaller stretchers, in that this would require the subsequent creation by a craftsman, on the new ends, of the end seatings for the connection of the sides of the stretcher, and of the tensioning springs or wedges. Since, moreover, the artist may select canvases of different types, for example made from linen, cotton, plastic fibre, etc, depending for example on the techniques or paints employed, the practical result is that it is wasteful for the producer and retailer to produce and stock a plurality of finished stretchers of different dimensions and with different canvases. Since such stretchers, once assembled, are somewhat bulky, this entails associated problems of storage, packaging and transport. These parameters, which are naturally also reflected in the selling costs, also determine the most convenient type of sale as a function of the market in question. Therefore in markets covering a large area, for example in the United States, Canada, Australia and the like, such stretchers are offered for sale not in a pre-mounted state but in the form of loose stretcher sides of various dimensions. The artist selects these stretcher sides closest to the dimensions of the picture which he intends to paint, and the canvas is selected separately. After assembly of the stretcher, he fixes the canvas with the tacks or staples, which likewise requires the availability of the appropriate tools. In markets of lesser extent, for example in various European countries, the stretchers are offered for sale in the pre-assembled state and with the canvas fixed thereon, generally boxed in packs of, for example, 6 or 12 stretchers for the retailer. This solution would however entail extremely high costs in the event of transportation over long distances, as mentioned above.

A further disadvantage of the knonw expansion stretchers resides in the fact that they can possess only a quadrangular shape, while there is a demand on the market for different form also, for example oval forms. In these cases, the application of means of tensioning the canvas is impossible, and the user has to fix the canvas in the traditional manner, with tacks or staples. A further disadvantage of the known expansion stretchers resides in the fact that, particularly with large dimensions, they require cruciform inserts in order to stiffen them, the practical effeicacy of which is somewhat limited since, as is well known, good stiffening of the canvases is achievable only with corner diagonals.

It is further stressed that any distribution on major markets of expansion stretchers having right-angled corner-pieces and springs would require them to be marketed in the form of kits containing the various components of the stretcher, which, bearing in mind the relevant number of standardized stretcher dimensions, would require a substantial expenditure not only for the machines automatically producing such packaging, but especially in respect of the relevant number of different packagings necessary, their transportation and their storage by the producer and retailer.

SUMMARY OF THE INVENTION

The object underlying the present invention is to create an artists' sectional stretcher with canvas which is capable of overcoming the inconveniences and disadvantages of the current stretchers forming a part of the prior art, which non-expandable permits stretcher the application of the canvas with resilient pre-stressing thereof in a simple and rapid manner, without the use of the known tacks or staples; i.e. in a removable manner, the fixing of the canvas with resilient pre-stressing being achieved by means of springs which are easy to produce and simple to apply, or to remove.

The abovementioned object includes the production of a non-expandable which can be assembled in a simple and rapid manner, employing sides which can be produced from any chosen material, prefereably plastic, for example on the basis of extruded profiles and subsequent cutting to size.

The abovementioned objects are achieved, according to the invention, by means of a sectional artists' stretcher with canvas.

Further developments and features of the proposed sectional stretcher with canvas are disclosed herein.

With the artists' sectional stretcher with canvas according to the invention, numerous substantial advantages are achieved in respect both of the new proposal for tensioning the canvas and the associated springs for resilient pre-stressing, and of the new proposal for producing an advantageous non-expandable stretcher, advantageously comprised of plastic profiles on sides, and in respect of the possibility of simplified, low-cost distribution of the stretchers which can be produced according to the teaching of the invention. In respect of the tensioning of the canvas, this is now achieved for the first time with a non-expandable stretcher over which the canvas is "pulled" with the aid of resilient means which, at the same time, form the means for fixing the canvas to the stretcher. Since these resilient means, or springs, can be applied in an extremely simple and arbitrary manner, they can be applied without problems by young people, students and ladies alike, as a result of which a substantial widening of the market proves possible, for example into the school and amateur sectors. These springs, whose resilient behaviour is extremely reliable, can be applied manually without the need for any equipment or tools, as a result of which the assembly of the picture can readily and conveniently be carried out at home, or at school or in the open air. For transport, the canvas can easily be removed from the stretcher, which is non-expandable but advantageously capable of being dismantled, and carried for example in the known draughtsman's tubes. The result is that the said stretcher can also be used repeatedly by the artist, or student, as a support for the canvases, with the associated practical advantages. The traction on the canvas is of the continuous type, and furthermore the canvas is under uniform traction over the entire length of the sides of the stretcher. The known "crescent" deformations between adjacent tacks are avoided, and furthermore the perimeter edge of the stretcher is devoid of tacks and staples. Since the stretchers are of the non-expandable type, they possess a constant dimension in terms of bulk, so that such stretchers can be accommodated without difficulty in the appropriate seatings of standardized picture frames. Application and fixing oif the canvas take an extremely short time, of the order of a few minutes, and the number of springs applied can be freely selected by the user. Such springs for fixing and resilient pre-stressing the canvas can advantageously be produced in a simple and automatic manner. The proposed non-expandable, can advantageously be produced without the use of wooden profiles. The said stretcher can, in fact, advantageously consist of plastic stretcher sides cut from initial extruded profiles which advantageously possess internal ribbings and chambers. For rapid assembly and dismantling, right-angled corner-pieces are advantageously provided to be introduced into such chambers. The latter, after the assembly of the stretcher, are concealed and the stretcher can be dismantled at anytime. The user can thus cut the stretcher sides to the desired size, either starting from the extruded profile or cutting the sides of a larger stretcher, for example acquired in the loose form, together with the canvas and the springs for pre-stressing and fixing the canvas. In practice, the user may acquire separately these springs, the canvas and the stretcher sides, or the appropriate extruded profiles, and the connecting corner-pieces, and may conveniently create his own stretchers to suit requirements. In the case of plastic profiles, the grooves necessary for the engagement of the springs for fixing the canvas are already produced thereon during the act of extrusion. Likewise, the known perimeter projections of the stretcher sides for supporting the canvas with a limited contact with the front and rear sides of the stretcher, as already known in the case of the wooden profiles, are of course likewise made on such plastic profiles. It is further possible to provide resilient spring means engaging directly on two oppsosite sides of the canvas. This further simplifies the fixing and the resilient pre-stressing thereof.

The spring elements for fixing, of the type bent substantially at right angles, furthermore advantageously permit the fixing and pre-stressing of the canvas on stretchers of a desired shape, for example oval stretchers. The stretchers can possess dimensions virtually as small as desired.

A further advantage of the stretcher made from plastic profiles resides in the fact of providing, on the stretcher sides, a fixing projection for diagonal stiffening supports for stretchers of large dimensions.

A further advantage of the resilient pre-stressing springs according to the invention resides in the fact that the artist can select the degree of tensioning of the canvas in a simple manner as a function of the number of springs used and of the elastic pre-stress imparted to each spring. Another important advantage resides in the fact that canvases which have previously been fixed to other stretchers in a traditional manner can be satisfactorily fixed on the proposed stretchers, which is particularly important in the sector of the fine arts, the antique trade and, in particular, restoration. For restorers, in fact, it is extremely important to be able to cut the new stretcher to size in situ and to apply the canvas reliably and rapidly.

Further advantages, details and features of the sectional stretchers with resiliently pre-stressable canvases according to the invention may be found in the description which follows, with reference to the attached drawings, in which are illustrated a preferred embodiment and a number of variations of the sectional stretcher and of the proposed spring elements for fixing and tensioning the canvas.

BRIEF DESCRIPTION OF THE DRAWINGS

In the drawings, the following are shown diagramatically or in principle:

FIG. 9 shows a rear view of a stretcher according to the invention with examples of application of diagonal supports according to the invention;

DETAILED DESCRIPTION OF THE PREFERRED EMBODIMENTS

Figure 1:
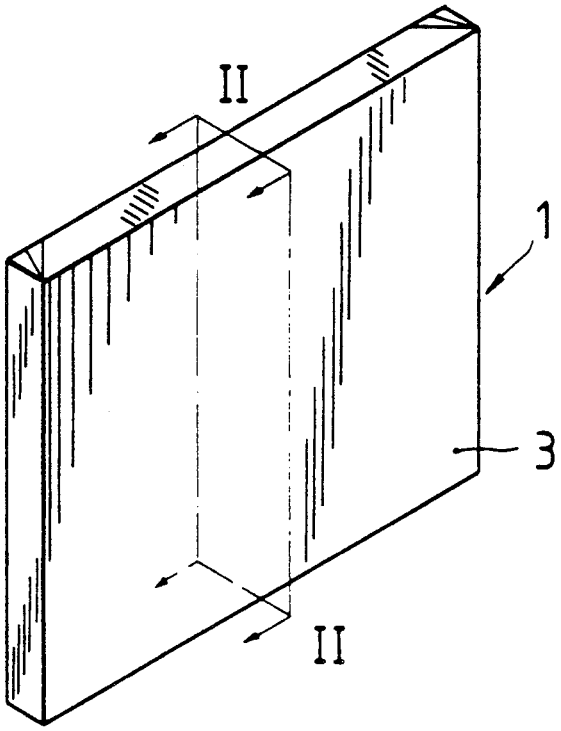
FIG. 1 shows a perspective view of a support stretcher with associated canvas, according to the invention, in an oblique frontal view.
Figure 2:
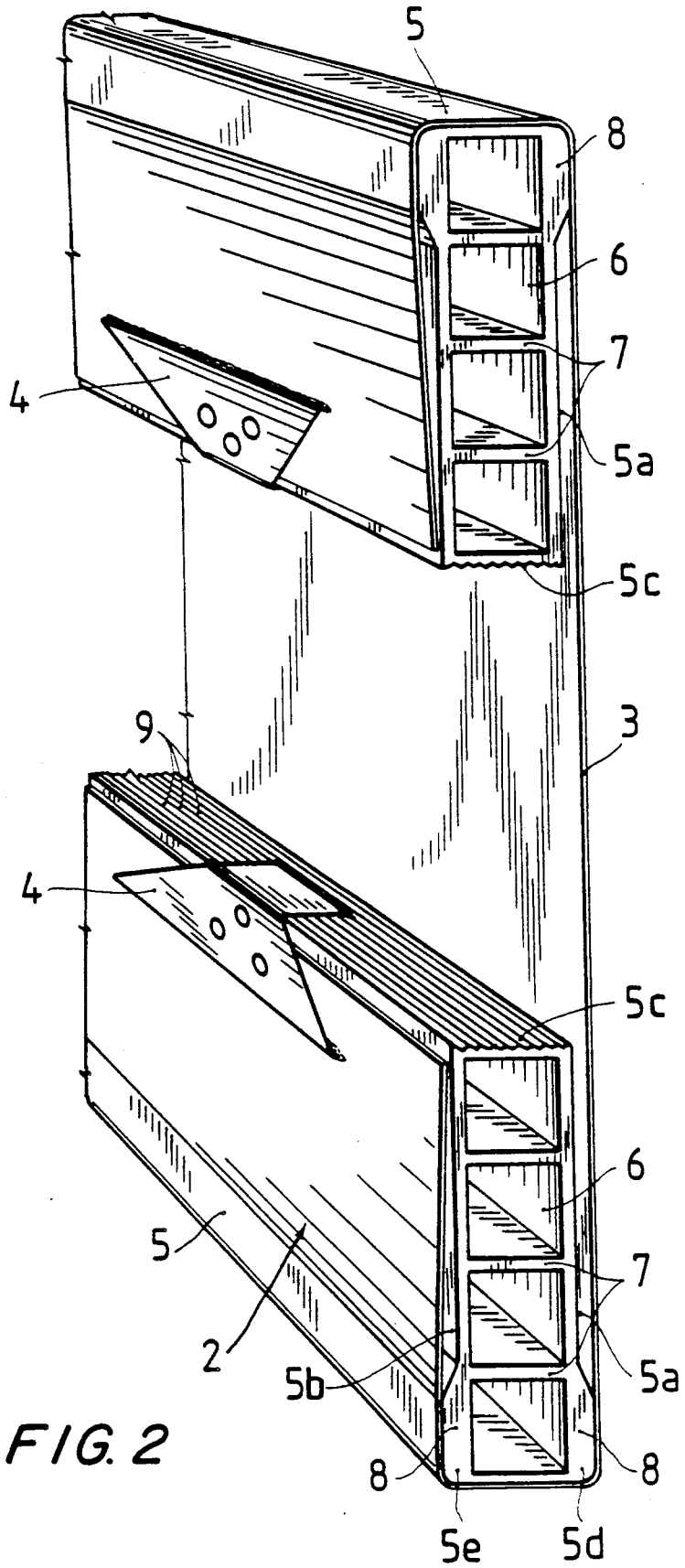
FIG. 2 shows a section along the line II—II in FIG. 1.
Figure 3:
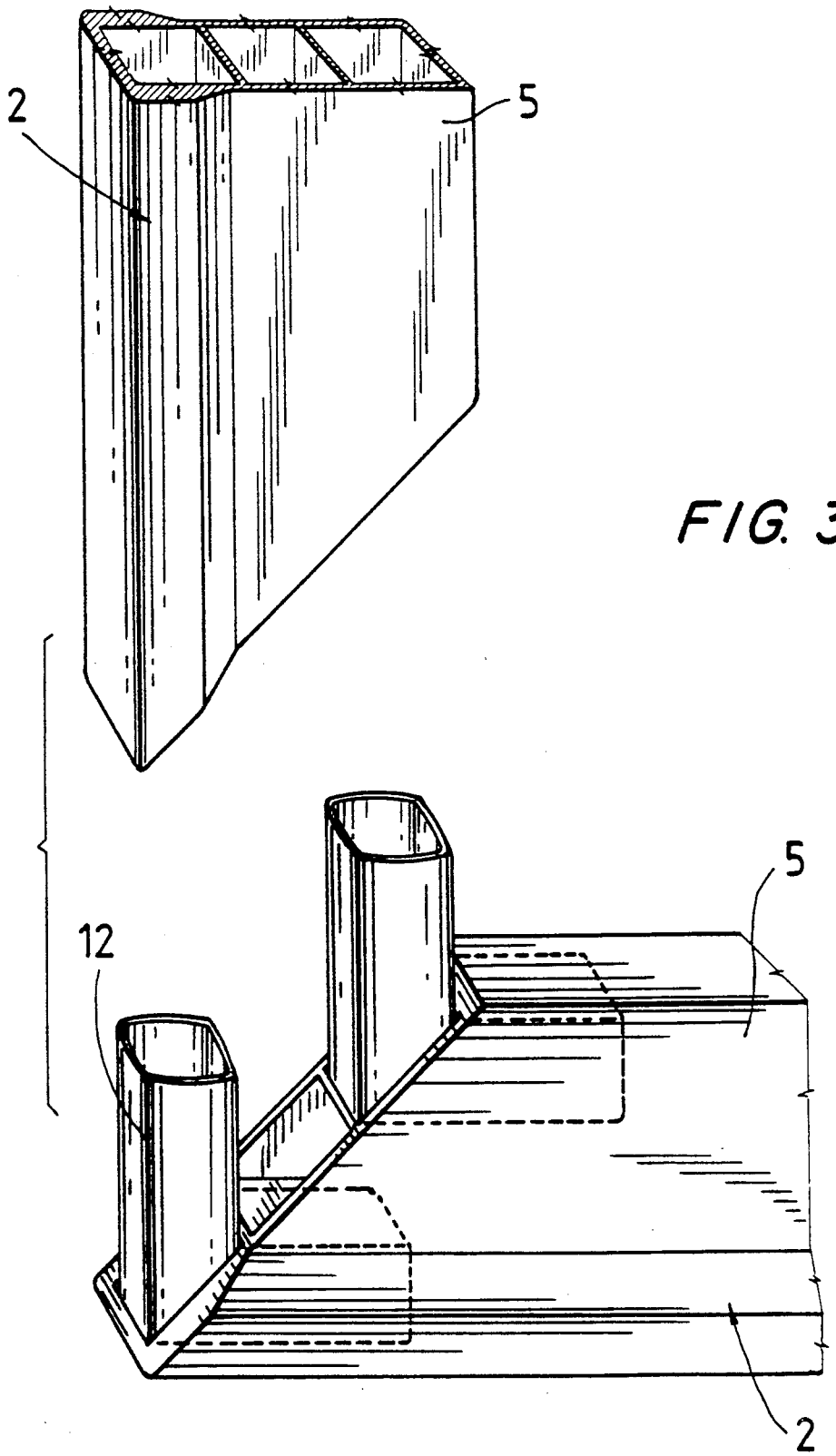
FIG. 3 shows a detail of a corner zone of the stretcher according to the invention, more specifically during an assembly stage.
Figure 4:
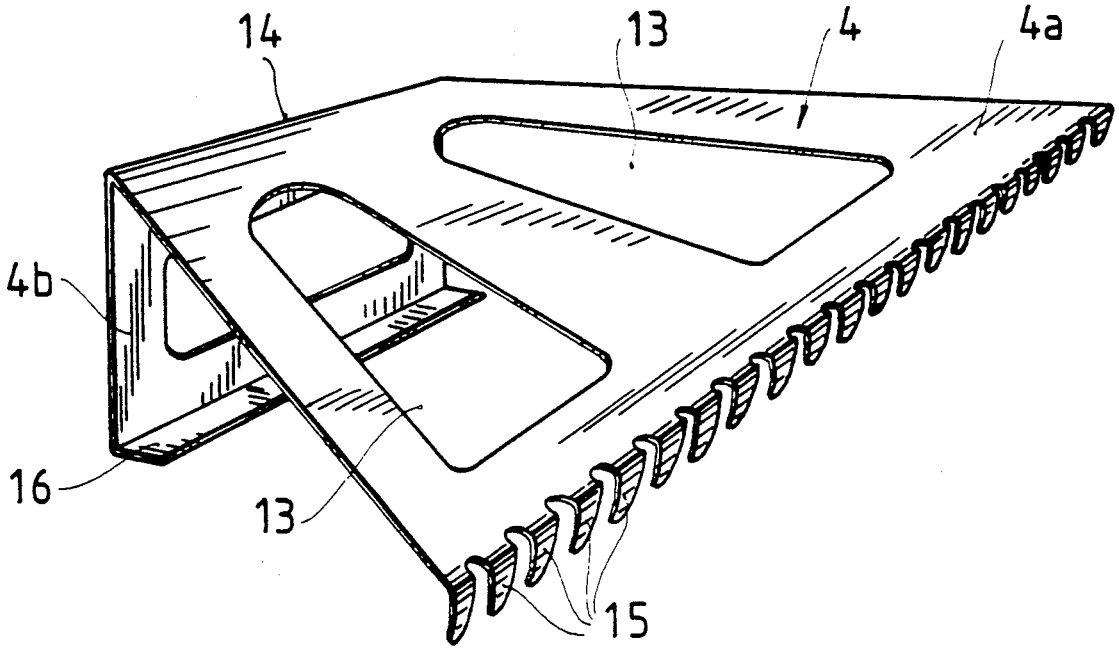
FIG. 4 shows a perspective view of a spring element for fixing and pre-stressing, according to the invention.
Figure 5:
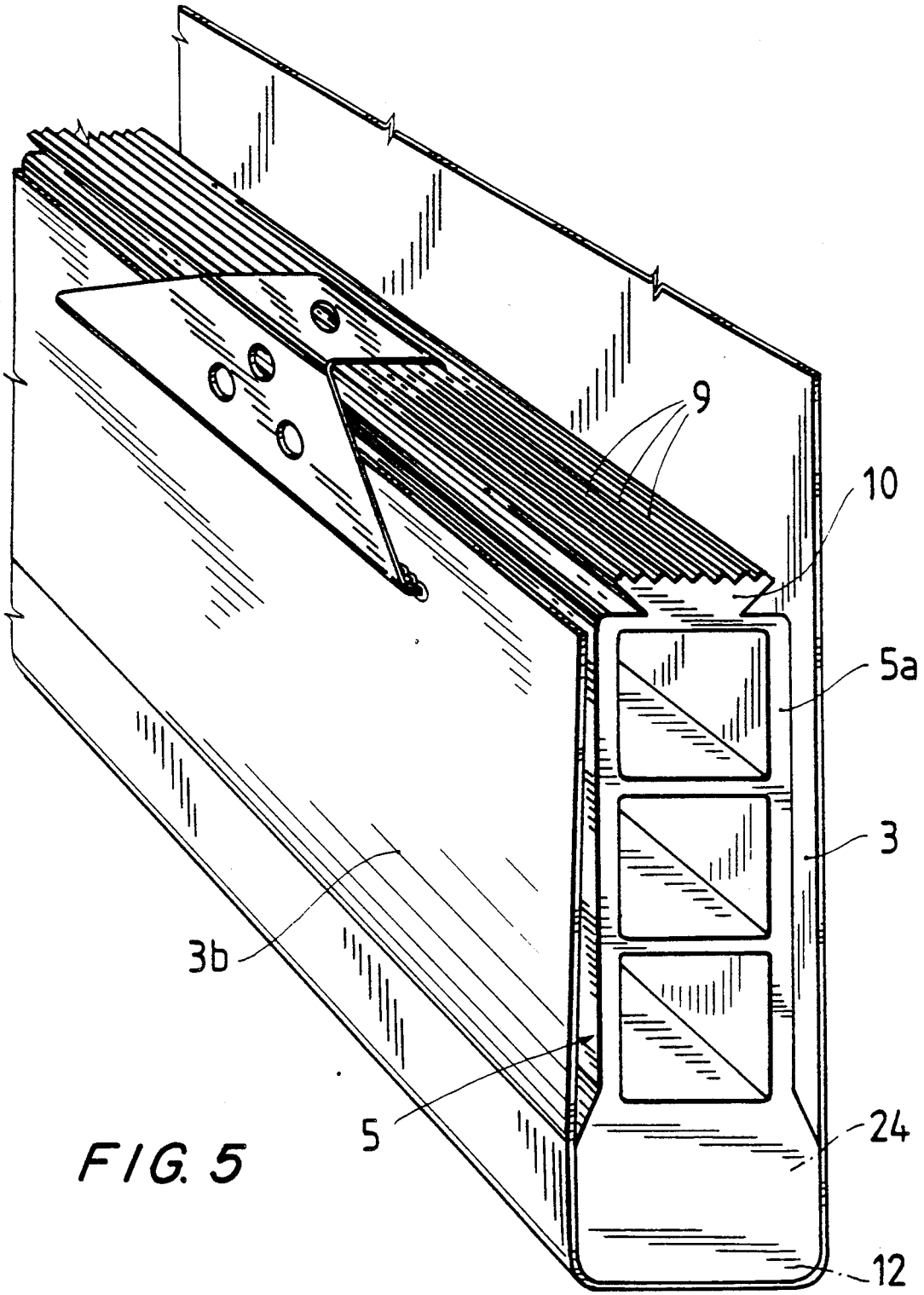
FIG. 5 shows a sectional detail through a side of the stretcher according to the invention, more specifically with an alternative embodiment of a plastic profile for a stretcher.
Figure 6:
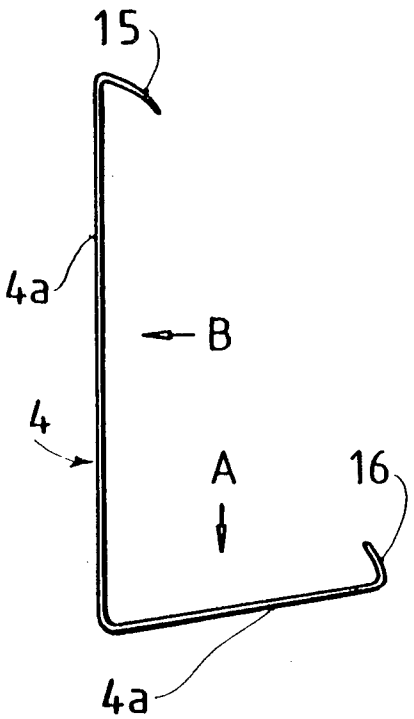
FIG. 6, 7 and 8 show an alternative embodiment of the fixing and pre-stressing spring according to the invention, in a median sectional view and in an internal view along the arrows A and B respectively.
Figure 8:
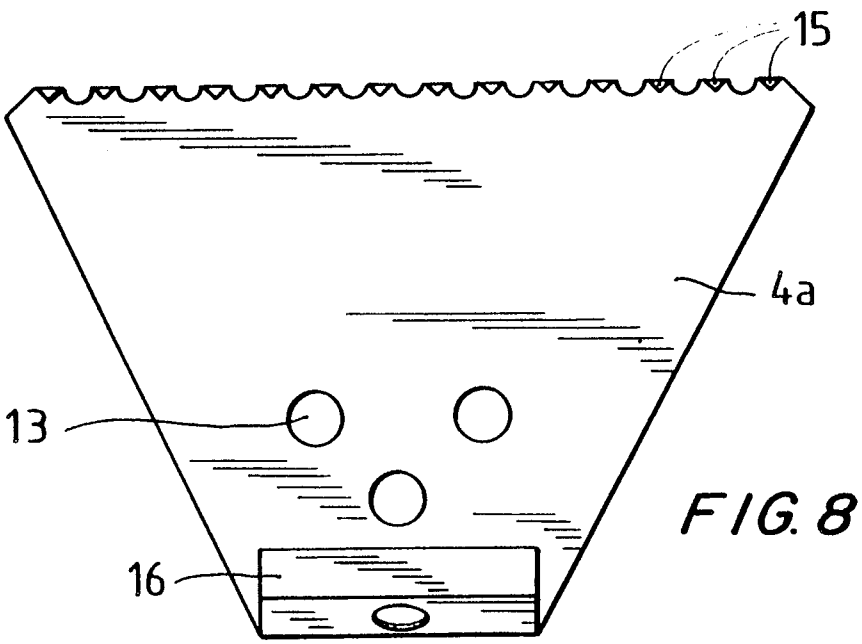
Figure 7:
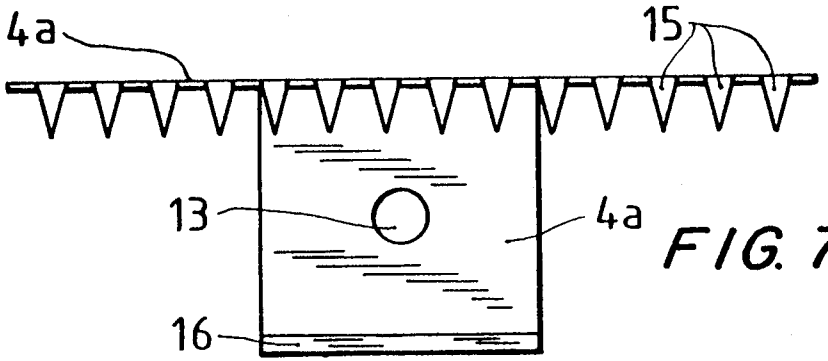

In the various figures, shown on different scales and with dimensional relationships which are convenient for greater clarity of illustration, the artists' sectional structure with canvas according to the invention is illustrated as a whole at 1. It is substantially formed from three components, more specifically a support frame of stretcher 2, advantageously of the rigid or non-expandable type, a canvas 3 and a plurality of resilient elements 4 serving simultaneously to fix and to tension the canvas 3. The stretcher, in the example illustrated, comprises four stretcher sides 5, which are obtained by simple end cutting at 45° from an extruded plastic profile, for example of the type illustrated in FIGS. 2 and 5. Such plastic profile 15 preferably symmetrical and possesses, for reasons of light weight and greater strength, internal chambers 6 and ribbings 7. Projections 8 serving, in a known manner, to keep the canvas 3 at a distance from the remaining anterior and posterior frontal surface 5*a*, 5*b* of the stretcher sides 5 are produced on the external frontal sides of the plastic profile. The stretcher sides, on their internal depthwise side 5*c* in the assembled state, possess one or more grooves 9 for the engagement of the leaf springs 4. as explained below. In FIG. 5 there is also made on the said internal depthwise side a projection, for example of dovetail type, 10 for anchoring a diagonal reinforcing support 11, to which further reference will be made subsequently. For the convenient and stable assembly of the stretcher sides 5 to form the stretcher 2, angular supports 12 are used (FIG. 3). These possess, for example, a hollow cross-section having at least one deformable side, for example a convex side, in order to guarantee a pressure fit when they are inserted into the chambers 6.

According to the invention, the fixing and the resilient pre-stressing, or tensioning, of the canvas 3 on the stretcher 2 take place simultaneously by means of the employment of spring elements 4, preferably leaf springs of the type having wings 4*a*, 4*b* folded back at an angle of less than 90°, as illustrated in FIGS. 4 and 6–8. In the wings 4*a* and 4*b* illustrated there, apertures 13 are made, the purpose of which is to render the said wings 4*a* and 4*b* more resilient and thus to prevent forced opening or spreading of the folded edge 14, which would compromise the resilient behaviour of the spring 4. The latter possesses, in the wider end of the wing 4*a*, a plurality of pointed teeth 15 folded over approximately orthogonally relative to the said wing 4*a*, while in the shorter wing 4*b* the free end 16 is folded over inwards, more precisely in a manner such as to engage in the one or more grooves 9 mentioned above. The teeth 15, for their part, engage into the edge 3*b* of the canvas 3, folded over along the posterior frontal side 5*b* of the strips 5, and more specifically at a distance therefrom resulting from the presence of the abovementioned projections 8. In this way, the spring 4, when applied, does not project beyond the said projections 8 and does not increase the bulk of the assembled stretcher 1, so that latter can conveniently be accommodated in the respective frame.

Figure 11:
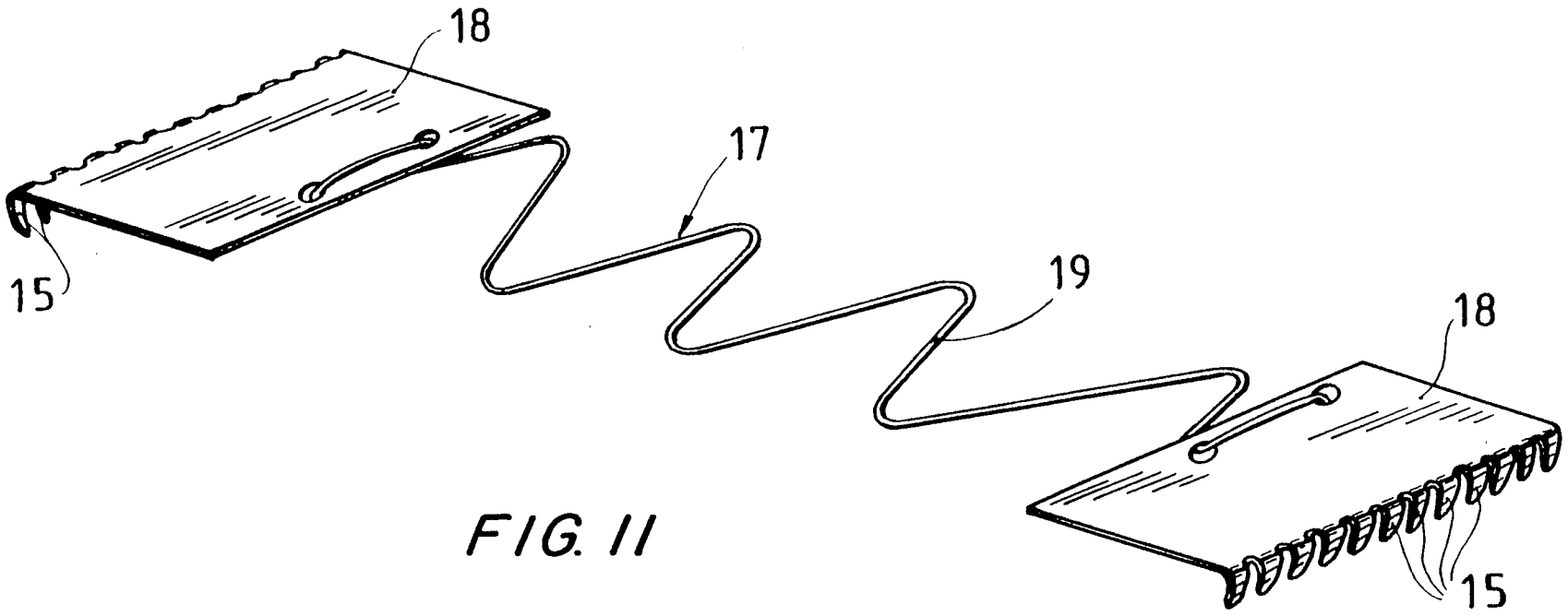
FIG. 11 shows a perspective view of a further alternative embodiment of the fixing and pre-stressing spring.

According to the invention, the springs for fixing and resiliently pre-stressing the canvas 3 may also possess a strip conformation, as shown in FIG. 11. In the said figure, the spring is designated as a whole by 17, and possesses two end portions 18 provided, on their outer side, with a plurality of teeth 15 as referred to above, the said toothed end portions 18 being mutually associated by an interposed spring 19, for example a wire-like spring of zig-zag conformation. With this spring 17, two respectively opposite edges 3*b* of the canvas 3 are each engaged by one toothed portion 18, as indicated in FIG. 9. At the same time, the springs 17 also constitute the means of fixing and tensioning the canvas 3 on the stretcher 2. The spring 19 may also take the form of a strip of rubber or the like.

The number of springs 4, or 17, may be selected arbitrarily by the user as a function of the dimensions of the picture and of the desired degree of tensioning, or as a function of the desired requirements in each case. Given the selected conformation of the springs 4 and 17, their application, and removal if required, can be performed by the user easily, quickly and safely, without exertion and without special tools. With this new concept of tensioning the canvas 3, the latter comes to bear uniformly along the outer edges 5*d* and 5*e* of the stretcher 2, over which edges it is stressed to slip, and in this way the known "crescent" deformations, inevitable with the use of metal clips and tacks, are reliably avoided.

When use is made of extruded plastic stretcher sides, it is advantageously possible to avoid both wastabe during production and subsequent working thereof. Furthermore, by means of the resilient pre-stressing means proposed, the canvas, when moved, slides on the stretcher with favourable dimensional ratios between the active and reactive engagements of the springs, as a result of which deformation and twisting of the stretcher are reliably avoided.

Figure 10:
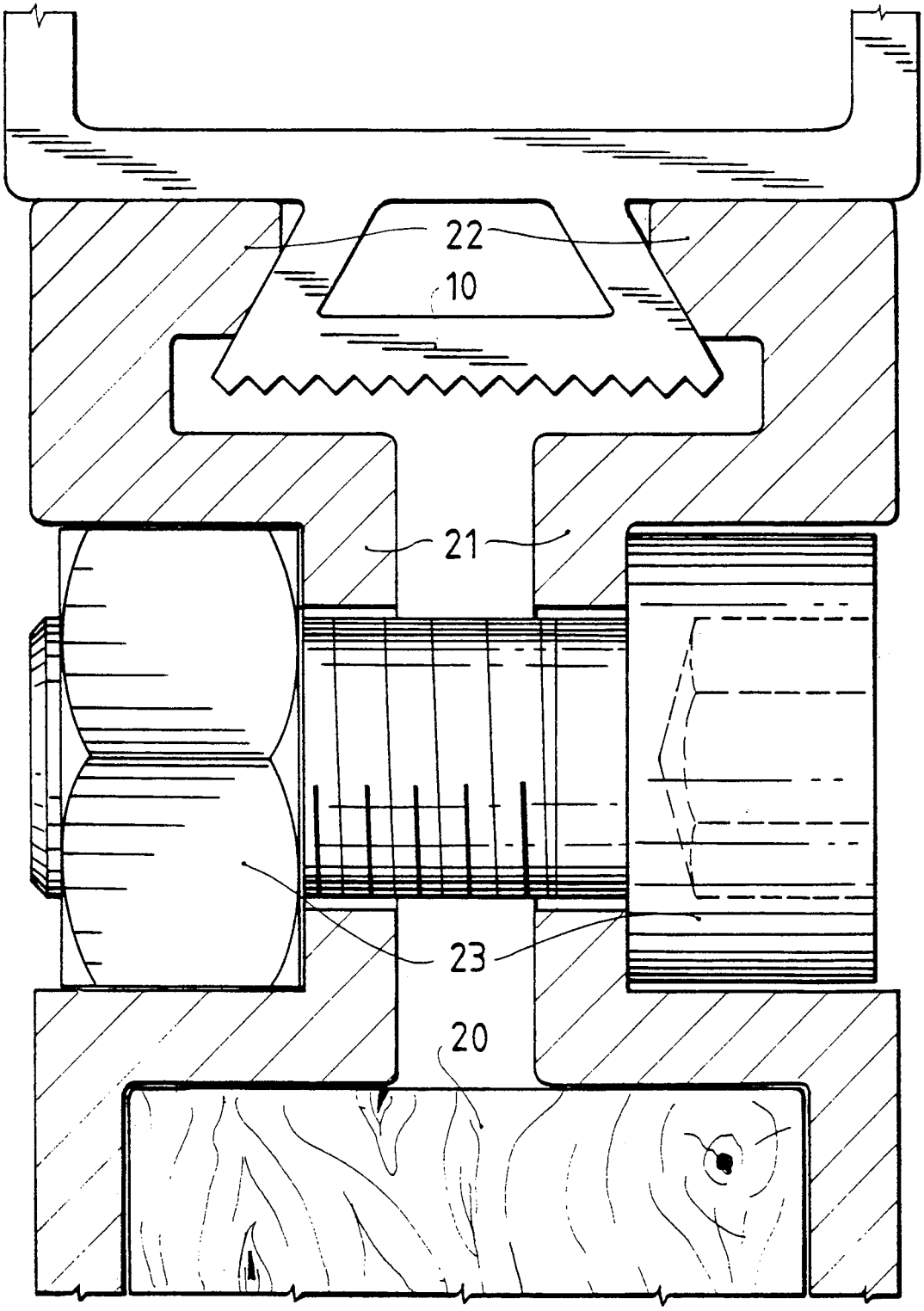
FIG. 10 shows a detail in the section X—X in the zone of engagement between the diagonal support and stretcher in FIG. 9.

In any case, including when the dimensions of the stretchers are large, optimum stiffening thereof is achieved, according to the invention, by the use of efficient diagonal supports, as indicated for example in FIG. 9, which leave free the central area of the canvas. To this end, such diagonals 11 may possess a rigid strip-shaped median portion 20 with end shoes 21, which shoes, at their opposed chamfered ends 22, engage on the outer sides of the profiled projection 10 (FIGS. 9, 10). Said shoes are mutually clampable by means of at least one screw 23 and are fixed, for example hinged, as desired, and in a manner not illustrated in greater detail, to the rigid strip-shaped median portion 20. With this arrangement the reinforcing diagonals 11 may possess any desired length, or be cut to the desired length, and may be disposed, for example, as illustrated in FIG. 9. In any case, the abovementioned clamping shoes 21 are freely mobile to slide along the projection 10, as a result of which the length of the diagonals 11 need not be particularly precise. A good interference fit between the assembly corner-pieces 12 and the chambers 6 of the stretcher side 5 may also be achieved, for example, by providing pointed ribbings 24 (FIG. 5) or using corner-pieces 12 of a slightly yielding material, for example rubber or the like, for example for use in schools.

From what has been stated above, it is clearly apparent that, with the sectional stretchers having canvases which can be resiliently pre-stressed by means of spring elements simultaneously acting as fixing and pres-stressing means, the objects on which the present invention is based are effectively achieved and the advantages referred above are obtained. In practice, all the individual parts may be replaced by others which are technically and/or functionally equivalent without, as a result, departing from the scope of protection of the present invention. The stretcher 2 may readily be produced with sides of a different kind, or of different material, for example metal, wood or the like, and similarly the assembly of the sides of the stretcher may be undertaken in the most varied ways, from simple tacking to moulding in a one-piece construction, again without departing from the scope of protection of the invention. The stiffening diagonals, also, may possess any desired shape, and for example may take the form of simple profiles, for example metal profiles, perforated at their ends, hinge pins being inserted in said perforations and passing respectively into one of a plurality of perforations made in a projection analogous to the projection 10 illustrated above. In view of the simplicity of this operation, it is not illustrated.

With the proposed solution, therefore, particularly important advantages are obtained relative both to the distribution and to the sale of pictures which can be produced in accordance with the teaching of the invention. In fact, it is now possible to market in loose form extruded profiles for the production of the sides of the stretchers, and also fixing and pre-stressing springs, and also canvases separately, or independently. This dramatically reduces the associated problems of manufacture as also of packaging, transport, strorage and sale. The said solution is therefore particularly advantageous for markets covering large and very large areas. Also particularly important is the convenience of using the stretchers with canvases according to the invention in the teaching sector, and the advantageous possibility of being able to apply and remove the canvas with the greatest simplicity, for example for transportation to school, or for fully commercial transport operations. Although optimum results are obtained using the flat spring fixing and pre-stressing means of the type illustrated in FIG. 11, it obviously falls within the scope of the present invention to employ spring means of different conformation, whenever the said means simultaneously perform the fixing action and the action of resiliently pre-stressing a canvas mounted in, as it were, a "slidable" manner over the associated stretcher.

The dimensions and materials of the various components envisaged may be freely selected, likewise without departing from the scope of the protection of the present invention. All the features of the components of the sectional stretcher with canvas according to the invention, or of the stretcher itself, which can be derived from the description, from the drawings and from the claims, are considered susbstantive for the present invention, whether individually or in any desired combination thereof.

I claim:

1. An artist's framing kit, comprising:

(a) a rigid stretcher frame having stretcher sides having front and rear surfaces;

(b) a canvas having a front canvas region overlying the front surfaces of the stretcher sides, said canvas extending past and folded around the stretcher sides to form rear marginal canvas regions overlying the rear surfaces of the stretcher sides; and (c) a plurality of inherently resilient elements, each independently operative for fixing, and for simultaneously automatically resiliently tensioning, the canvas on the stretcher frame, each resilient element being selectively positioned at a location on a respective rear marginal canvas region to exert a constant tensioning force at said location, each resilient element being removably mounted from the stretcher frame to another location on the respective rear marginal canvas region to exert a constant tensioning force at said other location.

2. The framing kit according to claim 1, wherein each resilient element has a pair of plate portions connected along a common edge and lying in intersecting planes, one of the plate portions terminating in a plurality of teeth for engaging a respective rear marginal canvas region, the other of the plate portions terminating in a bent mounting flange; and wherein each stretcher side includes a plurality of grooves for receiving a respective mounting flange in a selected one of the grooves.

3. The framing kit according to claim 2, wherein the intersecting planes form an angle of less than 90° relative to each other.

4. The framing kit according to claim 2, wherein the mounting flange extends generally perpendicularly of said other plate portion.

5. The framing kit according to claim 2, wherein each plate portion has apertures formed therethrough.

6. The framing kit according to claim 1, wherein each stretcher side has raised projections on the front and rear surfaces thereof, each resilient element drawing the canvas into taut engagement with the raised projections.

7. The framing kit according to claim 1, wherein the stretcher frame has four stretcher sides connected in a generally quadrilateral configuration, each stretcher side having mitered ends and an internal chamber extending along a respective stretcher side; and wherein the stretcher frame includes generally L-shaped connectors having legs fitted into the internal chambers of two adjacent stretcher sides.

8. The framing kit according to claim 7, wherein each stretcher side has an undercut, dovetail projection; and further comprising elongated reinforcing supports extending diagonally between each two adjacent stretcher sides, each reinforcing support having, at opposite ends thereof, means for clamping the respective reinforcing support to the undercut, dovetail projections of each two adjacent stretcher sides.

9. An artist's framing kit, comprising:

(a) a rigid stretcher frame having stretcher sides having front and rear surfaces;

(b) a canvas having a front canvas region overlying the front surfaces of the stretcher sides, said canvas extending past and folded around the stretcher sides to form rear marginal canvas regions overlying the rear surfaces of the stretcher sides; and (c) means for fixing, and for simultaneously resiliently tensioning, the canvas on the stretcher frame, including a plurality of resilient plastic elements, each selectively positioned at a location on a respective rear marginal canvas region to exert a constant tensioning force at said location, each resilient plastic element being removably mounted from the stretcher frame to another location on the respective rear marginal canvas region to exert a constant tensioning force at said other location.

10. An artist's framing kit, comprising:

(a) a rigid stretcher frame having stretcher sides, each having front and rear surfaces, and a closed, tubular cross-section;

(b) a canvas having a front canvas region overlying the front surfaces of the stretcher sides, said canvas extending past and folded around the stretcher sides to form rear marginal canvas regions overlying the rear surfaces of the stretcher sides; and (c) means for fixing, and for simultaneously resiliently tensioning, the canvas on the stretcher frame, including a plurality of resilient elements, each selectively positioned at a location or a respective rear marginal canvas region to exert a constant tensioning force at said location, each resilient element being removably mounted from the stretcher frame to another location on the respective rear marginal canvas region to exert a constant tensioning force at said other location.

11. The framing kit according to claim 10, wherein each stretcher side has a plurality of internal tubular chambers.

12. An artist's framing kit, comprising:

(a) a rigid stretcher frame having stretcher sides constituted of a synthetic plastic material and having front and rear surfaces;

(b) a canvas having a front canvas region overlying the front surfaces of the stretcher sides, said canvas extending past and folded about the stretcher sides to form rear marginal canvas regions overlying the rear surfaces of the stretcher sides; and (c) means for fixing, and for simultaneously resiliently tensioning, the canvas on the stretcher frame, including a plurality of resilient elements, each selectively positioned at a location on a respective rear marginal canvas region to exert a constant tensioning force at said location, each resilient element being removably mounted from the stretcher frame to another location on the respective rear marginal canvas region to exert a constant tensioning force at said other location.

13. The framing kit according to claim 12, wherein each resilient element includes a pair of plate portions lying in a common plane and interconnected by a spring, each plate portion terminating in a plurality of teeth for engaging a pair of rear marginal canvas regions spaced apart of each other.

* * * * *